United States Patent [19]

Kaneko et al.

[11] Patent Number: 4,482,905

[45] Date of Patent: Nov. 13, 1984

[54] HEAT SENSITIVE RECORD MATERIAL

[75] Inventors: Kazuo Kaneko; Toshio Obara; Michihiro Gonda; Katsumasa Kickawa; Mikiko Kanasugi, all of Tokyo, Japan

[73] Assignee: Hodogaya Chemical Co., Ltd., Tokyo, Japan

[21] Appl. No.: 511,933

[22] Filed: Jul. 8, 1983

[30] Foreign Application Priority Data

Aug. 31, 1982 [JP] Japan ..... 57-150052
Mar. 31, 1983 [JP] Japan ..... 58-54047

[51] Int. Cl.[3] ..... B41M 5/18

[52] U.S. Cl. ..... 346/207; 346/208; 346/209; 346/216; 346/217; 346/221

[58] Field of Search ..... 282/27.5; 427/150–153; 428/320.4–320.8, 323, 326, 327, 411, 488, 537, 913, 914

[56] References Cited

U.S. PATENT DOCUMENTS

Re. 30,803 11/1981 Davis ..... 282/27.5

*Primary Examiner*—Bruce H. Hess
*Attorney, Agent, or Firm*—Oblon, Fisher, Spivak, McClelland & Maier

[57] ABSTRACT

A heat sensitive record material comprising a support sheet and a record layer formed on the support sheet, the record layer being composed essentially of a colorless or light-colored fluoran compound, an acidic substance which is thermally reactive with the fluoran compound to develop a color and a binder, characterized in that said record layer contains an effective amount of at least one benzenesulfonamide compound represented by the general formula:

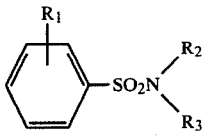

(I)

where $R_1$ is a hydrogen atom, a $C_1$–$C_5$ alkyl group, an acetylamino group or a halogen atom, $R_2$ is a hydrogen atom, a $C_1$–$C_5$ alkyl group, a cyclohexyl group or a phenyl group which may be substituted and $R_3$ is a $C_1$–$C_5$ alkyl group, a cyclohexyl group or a phenyl group which may be substituted, provided $R_2$ and $R_3$ may form together with N a saturated ring.

10 Claims, No Drawings

HEAT SENSITIVE RECORD MATERIAL

The present invention relates to a heat sensitive record material, and particularly to a heat sensitive record material having improved heat resistance, water resistance and heat sensitivity characteristics. More particularly, it relates to a heat sensitive record material having improved color-forming sensitivity.

It is desired that the record layer of the heat sensitive record material has no tendency for self-color development, minimum pressure sensitivity, good heat sensitivity, good light resistance, good heat decolorization resistance, good humidity decolorization resistance and good water resistance. However, there has been no record layer which completely satisfies these desired properties.

As a method for improving the heat sensitivity characteristics, Japanese examined patent publications Nos. 17748/1974 and 39567/1976 propose to employ a combination of an organic acid as an acidic substance and a phenol compound, or to use a polyvalent metal salt of a compound having an alcoholic hydroxyl group. Japanese unexamined patent publication No. 11140/1974 (Japanese patent publication No. 29945/1976) proposes to employ a copolymer of hydroxyethyl cellulose with a salt of maleic acid anhydride. Further, in Japanese unexamined patent publications Nos. 34842/1974, 115554/1974, 149353/1975, 106746/1977, 5636/1978, 11036/1978 and 48751/1978, it is disclosed to incorporate a nitrogen-containing organic compound such as thioacetanilide, phthalonitrile, acetamide, di-$\beta$-naphtyl-p-phenylenediamine, a fatty acid amide, acetoacetic anilide, diphenylamine, benzamido or carbazole, or a heat-fluidizable material such as 2,3-di-m-tolylbutane or 4,4'-dimethylbiphenyl, or a carboxylic acid ester such as dimethylisophthalate or diphenylphthalate, as a sensitizer.

The present inventors have prepared heat sensitive recording papers in accordance with the conventional methods and the methods disclosed in the above-mentioned various publications by using known fluoran compounds as the chromogenic material, and tested them for various properties required for the heat sensitive record paper, whereby it has been found that they are inferior in the heat sensitivity characteristics, i.e. the initial color-forming temperature (Ts) under heating is high, the rising temperature coefficient ($\gamma$) of the color density curve is small, or the maximum color density ($D_{max}$) is small. Thus, they are practically not useful as a heat sensitive record paper for facsimile, particularly for high-speed facsimile. Further, when the thermally color-developed record papers are left to stand in an atmosphere having a relative humidity of 20% at from 50° to 60° C. for from 3 to 5 days, the density of the color-developed chromogenic material decrease as compared with the color density immediately after the color-development. Namely, the heat decolorization resistance is small. When they are left in an atmosphere having a relative humidity of from 80 to 90% at from 50° to 60° C. for from 12 to 24 hours, the density of the color-developed chromogenic material decreases as compared with the color density immediately after the color-development, and in some cases, the color disappears completely leaving no trace of the color-developed chromogenic material. Namely, the humidity decolorization resistance is small. When a heat sensitive record paper wherein a water soluble binder is used as the binder or such a heat sensitive record paper which has been subjected to heat color-development, is immersed in water for a long period of time, the non-developed heat sensitive record layer as well as the color-developed heat sensitive layer tends to disperse or the color disappears. Namely, the water resistance is poor.

Further, the conventional compounds are likely to lead to a whitening phenomenon. Namely, white crystals will form on the surface at the color-developed portion soon after the color-development, whereby the commercial value of the heat sensitive paper will be impaired. The present inventors have conducted extensive researches to improve the above-mentioned drawbacks with respect to heat sensitive record materials in which known fluoran compounds are used, and as a result, have accomplished the present invention.

Namely, present invention provides a heat sensitive record material comprising a support sheet and a record layer formed on the support sheet, the record layer being composed essentially of a colorless or light-colored fluoran compound, an acidic substance which is thermally reactive with the fluoran compound to develop a color and a binder, characterized in that said record layer contains an effective amount of at least one benzenesulfonamide compound represented by the general formula:

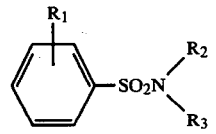

(I)

where $R_1$ is a hydrogen atom, a $C_1$–$C_5$ alkyl group, an acetylamino group or a halogen atom, $R_2$ is a hydrogen atom, a $C_1$–$C_5$ alkyl group, a cyclohexyl group or a phenyl group which may be substituted and $R_3$ is a $C_1$–$C_5$ alkyl group, a cyclohexyl group or a phenyl group which may be substituted, provided $R_2$ and $R_3$ may form together with N a saturated ring.

Now, the present invention will be described in detail with reference to the preferred embodiments.

The benzenesulfonamide compounds represented by the general formula I are synthesized from benzenesulfonyl chloride and an amine, and they are white crystals which are hardly soluble in water.

The colorless or light-colored fluoran compound to be used for the heat sensitive record material of the present invention may be selected from various known fluoran compounds, which may be represented by the following general formula:

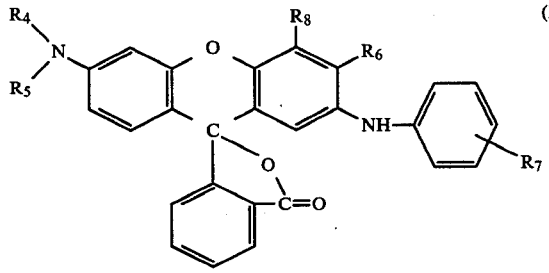

(II)

where $R_4$ is a $C_1$–$C_5$ alkyl group, $R_5$ is a $C_1$–$C_5$ alkyl group, a cyclohexyl group or a phenyl group which may be substituted, provided $R_4$ and $R_5$ may form together with the nitrogen atom a heterocyclic ring, $R_6$ is a hydrogen atom, a halogen atom, a $C_1$–$C_3$ alkoxy group or a $C_1$–$C_3$ alkyl group, $R_7$ is a hydrogen, atom, a $C_1$–$C_3$ alkyl group, a halogen atom or a trifluoromethyl group, and $R_8$ is a hydrogen atom or a $C_1$–$C_3$ alkyl group. Typical examples of such compounds are 2-(2-chlorophenylamino)-6-diethylaminofluoran, 2-(2-chlorophenylamino)-6-di-n-butylaminofluoran, 2-anilino-3-methyl-6-diethylaminofluoran, 2-anilino-3-methyl-6-pyrrolidinylfluoran, 2-anilino-3-methyl-6-piperidinofluoran, 2-(3-trifluoromethylanilino)-6-diethylaminofluoran, 2-anilino-6-diethylaminofluoran, 2-anilino-3-methyl-6-(N-ethyl-N-p-tolyl)aminofluoran, 2-(p-ethoxyanilino)-3-methyl-6-diethylaminofluoran, 2-xylidino-3-methyl-6-diethylaminofluoran, 2-anilino-3-methyl-6-(N-methyl-N-cyclohexylamino)fluoran, 2-anilino-3-chloro-6-diethylaminofluoran, 2-anilino-3,4-dimethyl-6-diethylaminofluoran and 2-anilino-3-methoxy-6-dibutylaminofluoran. However, useful fluoran compounds are not restricted to these specific examples.

The acidic substance to be used in the present invention is solid at room temperature and capable of being reacted with the chromogenic material when heated. Typical acidic substances include phenolic compounds disclosed in British Patent Specification No. 1,135,540 or colorless solid organic acids such as stearic acid, benzoic acid, gallic acid, and salicylic acid which are liquefied or vaporized at a temperature of 50° C. of higher or their metal salts such as aluminum or zinc salts. Particularly preferred acidic substances are the phenolic compounds, and a typical example is 4,4'-isopropylidene-diphenol (bisphenol A).

Now, typical examples of the benzenesulfonamide compounds represented by the general formula I according to the present invention will be listed in Table I. However, the present invention is not restricted to these specific examples.

TABLE I

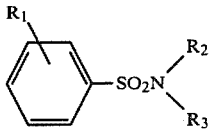

| Compound No. | $R_1$ | $R_2$ | $R_3$ | Melting point (°C.) |
|---|---|---|---|---|
| A | 4-$CH_3$ | H | 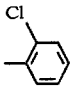 | 100–110° C. |
| B | 4-$CH_3$ | H | 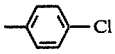 | 87–89° C. |
| C | 4-$CH_3$ | H | 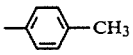 | 115–116° C. |
| D | 4-$CH_3$ | H | 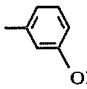 | 155–156° C. |
| E | 4-$CH_3$ | H | 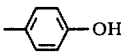 | 131–133° C. |

TABLE I-continued

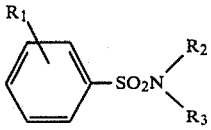

| Compound No. | $R_1$ | $R_2$ | $R_3$ | Melting point (°C.) |
|---|---|---|---|---|
| F | 4-$CH_3$ | H | 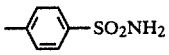 | 181–183° C. |
| G | 4-$CH_3$ | H | 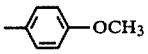 | 112.5–114° C. |
| H | 4-$NHCOCH_3$ | | 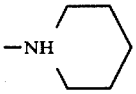 | 120–121° C. |
| I | 4-$NHCOCH_3$ | $CH_3$ | $CH_3$ | 139–141° C. |
| J | 4-$NHCOCH_3$ | | 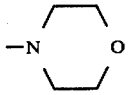 | 157–158° C. |
| K | 4-$CH_3$ | $CH_3$ | $CH_3$ | 80–81° C. |
| L | 4-$CH_3$ | | 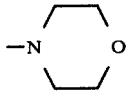 | 143–145° C. |
| M | 4-$CH_3$ | H | $CH_3$ | 74–75° C. |
| N | 4-$CH_3$ | | 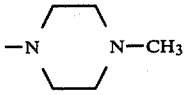 | 177–179° C. |
| O | 4-$NHCOCH_3$ | | 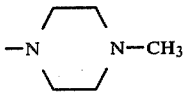 | 150–151° C. |
| P | H | H | 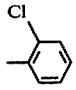 | 127–128° C. |
| Q | H | H | 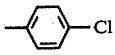 | 117–120° C. |
| R | H | H | 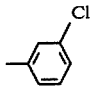 | 116–119° C. |
| S | H | H | 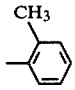 | 122–124° C. |
| T | H | H | 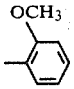 | 87–89° C. |

TABLE I-continued

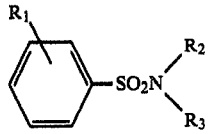

| Compound No. | $R_1$ | $R_2$ | $R_3$ | Melting point (°C.) |
|---|---|---|---|---|
| U | H | H | 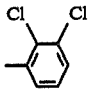 | 110–112° C. |
| V | H | H | 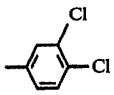 | 126–128° C. |
| W | H | H | 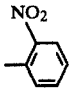 | 99–101° C. |
| X | H | | 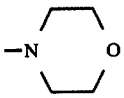 | 119–120°C. |
| Y | H | H | 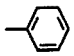 | 106–109° C. |
| Z | H | H | 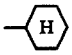 | 88–90° C. |
| AA | 4-Cl | H | 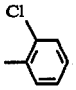 | 127–128° C. |
| AB | 4-Cl | H | 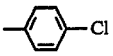 | 139–141° C. |
| AC | 4-Cl | H | 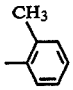 | 105–108° C. |
| AD | 4-Cl | H | 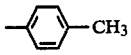 | 85–87° C. |
| AE | 4-Cl | H | 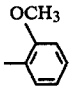 | 80–83° C. |
| AF | 4-Cl | H | 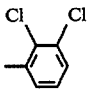 | 121–124° C. |
| AG | 4-Cl | H | 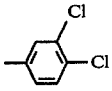 | 145–147° C. |
| AH | 4-Cl | | 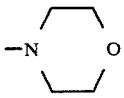 | 144–146° C. |

TABLE I-continued

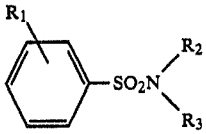

| Compound No. | $R_1$ | $R_2$ | $R_3$ | Melting point (°C.) |
|---|---|---|---|---|
| AI | 4-Cl | H | 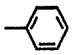 | 101–103° C. |
| AJ | 4-Cl | H | 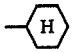 | 101–103° C. |
| AK | 4-Cl | $CH_3$ | $CH_3$ | 106–111° C. |
| AL | 2-$CH_3$ | H | 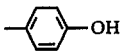 | 151–157° C. |

As the binder to bond a mixture comprising the chromogenic material, the acidic substance and the benzenesulfonamide compound to the support sheet, there may be used a water soluble or water insoluble binder. Typical examples are polyvinyl alcohol, methyl cellulose, hydroxyethyl cellulose, carboxymethyl cellulose, gum arabic, starch, gelatin, casein, polyvinyl pyrrolidone, a styrene-maleic acid anhydride copolymer, a polyacrylic acid amide, a polyacrylic acid salt, a terpene resin and a petroleum resin. Particularly preferred for the purpose of the present invention is a water soluble binder, and a typical water soluble binder is polyvinyl alcohol.

In the preparation of the heat sensitive record material of the present invention, it is preferred from the viewpoint of the properties of the heat sensitive record material to provide a single heat sesitive layer i.e. the record layer in which the fluoran compound as a chromogenic material, the acidic substance and at least one benzenesulfonamide compound of the general formula I are uniformly distributed in the form of fine particles. However, there may be employed a method wherein the chromogenic material and the benzenesulfonamide compound are uniformly distributed in fine particle form in a first layer which is juxtaposed with a second layer in which fine particles of the acidic substance are uniformly distributed; or a method wherein the acidic substance and the benzenesulfonamide compound are uniformly distributed in fine particle form in a first layer which is juxtaposed with a second layer in which fine particles of the chromogenic material are uniformly distributed; or a method wherein the chromogenic material, the benzenesulfonamide compound and the acidic substance are uniformly distributed in the respective separate layers which are intimately adhered to one another.

In the preparation of the heat sensitive record material of the present invention, the record layer usually comprises 1 part by weight of the chromogenic material, from 0.1 to 10 parts by weight, preferably from 0.3 to 3 parts by weight, of the benzenesulfonamide compound, from 2 to 10 parts by weight, preferably from 4 to 6 parts by weight, of the acidic substance and from 2 to 10 parts by weight, preferably from 3 to 5 parts by weight, of the binder.

The chromogenic material, the acidic substance and the benzenesulfonamide compound are preferably separately dispersed and pulverized in aqueous or organic media containing the binder, preferably in aqueous media in which the binder is dissolved, by means of a dispersing machine such as a ball mill, a sand mill or a paint conditioner, to obtain dispersions containing the respective particles having a particle size of from 1 to 6 μm, preferably from 3 to 5 μm. If necessary, an anti-foaming agent, a dispersing agent or a brightening agent may be added at the time of the dispersing and pulverization.

The respective dispersions thus obtained are mixed to obtain a coating composition comprising the respective components in the above-mentioned weight ratio for the heat sensitive record layer. This coating composition is applied onto the surface of a support sheet by means of a wire bar #6 to #10 so that the weight of the solid after drying becomes to be from 3 to 7 g/m$^2$, and then dried in an air-circulating drier at a temperature of from room temperature to 70° C., to obtain a heat sensitive record material. If necessary, an inorganic or organic filler may be added to the coating composition to improve e.g. the anti-adhesion to the heating head or the writability.

The heat sensitive record material of the present invention thus obtained has superior heat sensitivity, heat decolorization resistance, humidity decolorization resistance and water resistance, and is free from the whitening phenomenon which impairs the commercial value of the heat sensitive record material, whereby the drawbacks inherent to the conventional heat sensitive record materials have been overcome.

The properties of the record layer of the heat sensitive record material were determined by the following test methods. Namely, the color densities such as the color densities of the self-color development, the color densities after the heat color development at various temperatures and the decolorization densities of the chromogenic materials left in the heated or humidified atmosphere after the heat color development, were measured by means of Macbeth RD-514 model reflective density meter. The color development was conducted at a heating temperature of from 80° to 170° C. for a heating time of 3 seconds under a load of 100 g/cm$^2$ by means of lodiaceta thermotest rhodiacita (manufactured by French National Fiber Research Institute). Further, the decolorization of the chromogenic materials after the heat color development was conducted in a constant temperature and humidity testing apparatus.

Now, the present invention will be described in detail with reference to Examples. However, it should be understood that the present invention is not restricted to these specific examples.

In the following Examples, "parts" means "parts by weight".

EXAMPLE 1

(Compound Nos. A to O were used.)

| | |
|---|---|
| Dispersion A (Dispersion of a chromogenic material) | |
| 2-(2-chlorophenylamino)-6-diethylamino-fluoran | 4.0 parts |
| Aqueous solution containing 10% by weight of polyvinyl alcohol | 40.0 parts |
| Dispersion B (Dispersion of a developer) | |
| 4,4'-isopropylidenediphenol(bisphenol A) | 7.0 parts |
| Aqueous solution containing 10% by weight of polyvinyl alcohol | 40.0 parts |
| Water | 10.0 parts |
| Dispersion C (Dispersion of a benzenesulfonamide compound | |
| Benzenesulfonamide compound (Compound Nos. A to O as identified in Table I) | 7.0 parts |
| Aqueous solution containing 10% by weight of polyvinyl alcohol | 40.0 parts |
| Water | 10.0 parts |

Each dispersion having the above composition was pulverized in a ballmill to a particle size of from 2 to 3 μm.

Then, the dispersions were mixed in the following proportions to obtain a coating composition.

| | |
|---|---|
| Dispersion A (Dispersion of the chromogenic compound) | 3 parts |
| Dispersion B (Dispersion of the developer) | 10 parts |
| Dispersion C (Dispersion of the benzenesulfonamide compound) | 3 parts |

As a Comparative Example, Dispersions A and B were mixed in the following proportions to obtain a coating composition.

| | |
|---|---|
| Dispersion A (Dispersion of the chromogenic material) | 3 parts |
| Dispersion B (Dispersion of the developer) | 10 parts |
| Water | 3 parts |

Each of these coating compositions was coated on the surface of a sheet of high quality paper by means of a wire bar coater #10 in such an amount that the weight of the solid after drying became 5 g/m$^2$, and then dried in an air-circulating drier. The heat sensitive record paper thereby obtained was subjected to various property tests for the heat sensitive record material. The results thereby obtained are shown in Table II, in which the heat sensitive record papers of the present invention are identified by (a) to (o), and the heat sensitive record paper of the Comparative Example is identified by (xx).

TABLE II

| | Heat sensitive record paper No. | Benzene sulfonamide Compound No. | Surface texture*1 | | | Color density*1 | | | Color-forming characteristics | |
|---|---|---|---|---|---|---|---|---|---|---|
| | | | Immediately after color development | After being*2 kept under heated and humidified condition | After*3 irradiation | Immediately after color development | After being*2 kept under heated and humidified condition | After*3 irradiation | Ts (°C.)*5 | γ*5 |
| Example 1 of the present invention | a | A | 0.06 | 0.12 | 0.10 | 1.17 | 1.08 (0.82)*4 | 1.08 (0.93)*4 | 83 | 6.90 |
| | b | B | 0.07 | 0.22 | 0.10 | 1.19 | 1.10 (0.98) | 1.02 (0.98) | 78 | 3.17 |
| | c | C | 0.08 | 0.19 | 0.11 | 1.19 | 1.13 (0.96) | 1.14 (0.92) | 84.5 | 3.92 |

TABLE II-continued

| | Heat sensitive record paper No. | Benzene sulfonamide Compound No. | Surface texture*1 Immediately after color development | Surface texture*1 After being*2 kept under heated and humidified condition | Surface texture*1 After*3 irradiation | Color density*1 Immediately after color development | Color density*1 After being*2 kept under heated and humidified condition | Color density*1 After*3 irradiation | Color-forming characteristics Ts (°C.)*5 | Color-forming characteristics γ*5 |
|---|---|---|---|---|---|---|---|---|---|---|
| | d | D | 0.05 | 0.22 | 0.10 | 1.30 | 1.21 (0.94) | 1.20 (0.93) | 98 | 4.94 |
| | e | E | 0.08 | 0.23 | 0.12 | 1.34 | 1.18 (1.07) | 1.18 (1.06) | 91 | 3.57 |
| | f | F | 0.06 | 0.15 | 0.11 | 1.11 | 1.06 (0.93) | 1.18 (1.07) | 102.5 | 3.92 |
| | g | G | 0.07 | 0.24 | 0.11 | 1.13 | 0.95 (0.64) | 1.10 (1.03) | 81.5 | 3.23 |
| | h | H | 0.07 | 0.19 | 0.15 | 1.17 | 1.03 (0.98) | 1.07 (0.98) | 94 | 5.92 |
| | i | I | 0.11 | 0.23 | 0.15 | 1.14 | 1.09 (0.92) | 1.05 (0.97) | 87 | 6.72 |
| | j | J | 0.09 | 0.18 | 0.12 | 1.18 | 1.03 (1.06) | 1.05 (0.94) | 91 | 6.67 |
| | k | K | 0.10 | 0.10 | 0.20 | 1.13 | 1.13 (0.85) | 1.06 (1.03) | 88.5 | 4.50 |
| | l | L | 0.07 | 0.18 | 0.13 | 1.21 | 1.17 (.97) | 1.06 (1.02) | 95 | 5.27 |
| | m | M | 0.14 | 0.14 | 0.14 | 1.14 | 1.03 (0.97) | 1.05 (1.06) | 103 | 4.41 |
| | n | N | 0.05 | 0.15 | 0.11 | 1.20 | 1.14 (1.09) | 1.19 (1.12) | 108 | 4.59 |
| | o | O | 0.07 | 0.14 | 0.13 | 1.23 | 1.18 (1.15) | 1.21 (1.17) | 102 | 5.92 |
| Comparative Example | xx | — | 0.11 | 0.16 | 0.22 | 1.01 | 0.96 (0.41) | 1.01 (0.79) | 125 | 2.7 |

Notes:
*1: The surface texture and the color density were measured by a visual filter by means of Macbeth reflective density meter RD-514 model. The heat development was conducted at a temperature of 150° C. for 3 seconds under a load of 100 g/cm$^2$.
*2: Each heat sensitive record paper was kept at 60° C. for 24 hours under a relative humidity (RH) of 80%.
*3: The irradiation was conducted for 6 hours by means of a carbon arc fading tester.
*4: The first numerical value represents the reflective color density where the color was developed after the record paper was kept under the above-mentioned conditions (see *2 and *3), and the numerical value in the bracket represents a reflective color density after the record paper was kept under the above-mentioned conditions in a color-developed state.
*5: The "γ" represents a value obtained by multiplying tan θ by 100 where tan θ is the maximum inclination in the color density-color forming temperature curve in a graph in which the color density is represented by the vertical axis and the color development temperature is represented by the horizontal axis. The value "γ" represents the rising coefficient of the color development. Further, "Ts" is an intersection of the tangent at the maximum inclination with the temperature axis, and it represents the initial temperature of the color development. Further, the heat color development was conducted at a heating temperature of from 70 to 160° C. for a heating time of 5 seconds under a load of 100 g/cm$^2$ by means of lodiaceta model thermo-test rhodiacita (manufactured by French National Fiber Research Institute).

It is evident from Table II that the heat sensitive record papers (a) to (o) of the present invention have higher color densities than the heat sensitive record paper (xx) of the Comparative Example, and they are particularly superior in the color-forming sensitivity.

EXAMPLE 2

(Compound Nos. P to AL were used.)

| | |
|---|---|
| Dispersion D (Dispersion of a chromogenic material) | |
| 2-(2-chlorophenylamino)-6-dibutylamino-fluoran | 4.0 parts |
| Aqueous solution containing 10% by weight of polyvinyl alcohol | 40.0 parts |
| Dispersion E (Dispersion of a developer) | |
| 4,4'-isopropylidenediphenol(bisphenol A) | 7.0 parts |
| Aqueous solution containing 10% by weight of polyvinyl alcohol | 40.0 parts |
| Water | 10.0 parts |
| Dispersion F (Dispersion of a benzene-sulfonamide compound) | |
| Benzenesulfonamide compound (Compound Nos. P to AL as identified in Table I) | 7.0 parts |
| Aqueous solution containing 10% by weight of polyvinyl alcohol | 40.0 parts |
| Water | 10.0 parts |

Each dispersion having the above composition was pulverized in a ballmill to a particle size of from 2 to 3 μm.

Then, the dispersions were mixed in the following proportions to obtain a coating composition.

| | |
|---|---|
| Dispersion D (Dispersion of the chromogenic material) | 3 parts |
| Dispersion E (Dispersion of the developer) | 10 parts |
| Dispersion F (Dispersion of the benzene-sulfonamide compound) | 3 parts |

Further, as a Comparative Example, dispersions D and E were mixed in the following proportions to obtain a coating composition.

| | |
|---|---|
| Dispersion D (Dispersion of the chromogenic material) | 3 parts |
| Dispersion E (Dispersion of the developer) | 10 parts |
| Water | 3 parts |

Each coating composition was applied onto the surface of a sheet of high quality paper by means of a wire bar coater #10 so that the weight of the solid after drying became to be 5 g/m$^2$, and then dried in an air-circulating drier.

The heat sensitive recording paper thus obtained was subjected to various property tests for the heat sensitive record material. The results are shown in Table III, wherein the heat sensitive record papers of the present invention are identified by (p) to (al) and the heat sensitive record paper of the Comparative Example is identified by (yy).

EXAMPLE 3

Dispersion D (dispersion of the chromogenic material) and Dispersion E (dispersion of the developer) were prepared in the same manner as in Example 2.

| | |
|---|---|
| Dispersion G (Dispersion of a benzenesulfonamide compound) | |
| Benzenesulfonamide compound (Compound No. S as identified in Table I) | 7.0 parts |
| Aqueous solution containing 10% by weight of polyvinyl alcohol | 40.0 parts |
| Water | 10.0 parts |
| Dispersion H (Dispersion of a benzenesulfonamide compound) | |
| Benzenesulfonamide compound (Compound No. V as identified in Table I) | 7.0 parts |
| Aqueous solution containing 10% by weight of polyvinyl alcohol | 40.0 parts |
| Water | 10.0 parts |

Each dispersion having the above composition was pulverized in a ballmill to a particle size of from 2 to 3 μm.

Then, the dispersions were mixed in the following proportions to obtain a coating composition.

| | |
|---|---|
| Dispersion D (Dispersion of the chromogenic material) | 3.0 parts |
| Dispersion E (Dispersion of the developer) | 10.0 parts |
| Dispersion G (Dispersion of the Compound No. S as identified in Table I) | 1.5 parts |
| Dispersion H (Dispersion of Compound No. V as identified in Table I) | 1.5 parts |

This coating composition was applied onto the surface of a sheet of high quality paper in the same manner as in Example 2. The heat sensitive record paper thereby obtained was subjected to various property tests. The results are shown in Table III.

TABLE III

| | Heat sensitive record paper No. | Benzenesulfonamide Compound No. | Surface texture*1 | | | Color density*1 | | | Color-forming characteristics | |
|---|---|---|---|---|---|---|---|---|---|---|
| | | | Immediately after color development | After being*2 kept under heated and humidified condition | After*3 irradiation | Immediately after color development | After being*2 kept under heated and humidified condition | After*3 irradiation | Ts (°C.) | γ*5 |
| Example 2 of the present invention | p | P | 0.06 | 0.10 | 0.13 | 1.20 | 1.10 (0.54)*4 | 1.04 (0.74)*4 | 89 | 11.0 |
| | q | Q | 0.05 | 0.10 | 0.11 | 1.27 | 1.20 (1.15) | 1.15 (0.82) | 85 | 7.9 |
| | r | R | 0.05 | 0.11 | 0.12 | 1.30 | 1.18 (0.93) | 1.13 (0.88) | 84.5 | 6.8 |
| | s | S | 0.05 | 0.16 | 0.11 | 1.30 | 1.22 (1.15) | 1.16 (0.79) | 88 | 15.4 |
| | t | T | 0.08 | 0.21 | 0.13 | 1.37 | 1.16 (0.88) | 1.12 (0.73) | 70 | 4.0 |
| | u | U | 0.09 | 0.18 | 0.12 | 1.20 | 1.24 (1.08) | 1.07 (0.86) | 88 | 8.3 |
| | v | V | 0.05 | 0.15 | 0.12 | 1.24 | 1.35 (1.25) | 1.28 (0.88) | 89 | 10.0 |
| | w | W | 0.11 | 0.18 | 0.12 | 1.22 | 1.24 (1.08) | 1.10 (0.74) | 80 | 5.3 |
| | x | X | 0.08 | 0.09 | 0.10 | 1.22 | 1.12 (0.62) | 1.07 (0.82) | 86.5 | 3.9 |
| | y | Y | 0.06 | 0.10 | 0.11 | 1.21 | 1.18 (0.94) | 1.11 (0.80) | 82 | 8.0 |
| | z | Z | 0.09 | 0.15 | 0.14 | 1.23 | 1.20 (0.98) | 1.10 (0.89) | 78 | 4.2 |
| | aa | AA | 0.06 | 0.14 | 0.12 | 1.18 | 1.24 (1.13) | 1.21 (0.75) | 93 | 14.3 |
| | ab | AB | 0.08 | 0.15 | 0.12 | 1.22 | 1.22 (1.16) | 1.26 (0.89) | 92 | 10.5 |
| | ac | AC | 0.09 | 0.14 | 0.11 | 1.20 | 1.17 (0.84) | 1.11 (0.76) | 87.6 | 8.9 |
| | ad | AD | 0.07 | 0.41 | 0.13 | 1.21 | 1.22 (1.18) | 0.99 (0.90) | 75 | 3.9 |
| | ae | AE | 0.09 | 0.24 | 0.13 | 1.24 | 1.18 (0.91) | 0.99 (0.81) | 70.5 | 4.1 |
| Example 2 | af | AF | 0.05 | 0.11 | 0.10 | 1.26 | 1.20 (1.10) | 1.16 (0.89) | 89.0 | 12.5 |
| | ag | AG | 0.05 | 0.09 | 0.10 | 1.19 | 1.01 (0.95) | 0.98 (0.90) | 90.6 | 12.5 |
| | ah | AH | 0.08 | 0.10 | 0.11 | 1.17 | 1.09 (0.87) | 1.08 (0.97) | 87.0 | 3.2 |
| | ai | AI | 0.11 | 0.12 | 0.12 | 1.25 | 1.01 (0.92) | 1.10 (1.01) | 80.0 | 8.3 |
| | aj | AJ | 0.09 | 0.11 | 0.12 | 1.27 | 1.10 (0.92) | 0.98 (0.91) | 87.0 | 8.2 |
| | ak | AK | 0.12 | 0.09 | 0.13 | 1.24 | 1.09 (0.80) | 0.93 (0.28) | 86.0 | 12.0 |
| | al | AL | 0.04 | 0.07 | 0.09 | 1.17 | 1.03 (0.95) | 0.99 (0.90) | 90.1 | 13.2 |
| Example 3 | am | S or V | 0.05 | 0.09 | 0.10 | 1.3 | 1.20 (1.13) | 1.15 (0.88) | 82 | 9.2 |
| Comparative | yy | — | 0.09 | 0.14 | 0.19 | 1.11 | 1.01 | 1.05 | 121 | 3.9 |

TABLE III-continued

| Heat sensitive record paper No. | Benzene-sulfon-amide Com-pound No. | Surface texture*1 Immediately after color development | Surface texture*1 After being*2 kept under heated and humidified condition | Surface texture*1 After*3 irradi-ation | Color density*1 Immediately after color development | Color density*1 After being*2 kept under heated and humidified condition | Color density*1 After*3 irradi-ation | Color-forming characteristics Ts (°C.) | Color-forming characteristics γ*5 |
|---|---|---|---|---|---|---|---|---|---|
| Example | | | | | | (0.5) | (0.82) | | |

Note:
*1 to *5 have the same meanings as described with respect to Table II.

It is apparent from Table III that the heat sensitive record papers (p) to (am) obtained by Examples 2 and 3 of the present invention have higher color densities than the heat sensitive record paper (yy) of the Comparative Example, and they are particularly superior in the color-forming sensitivity.

We claim:

1. A heat sensitive record material comprising a support sheet and a record layer formed on the support sheet, the record layer being composed essentially of a colorless or light-colored fluoran compound, an acidic substance which is thermally reactive with the fluoran compound to develop a color and a binder, characterized in that said record layer contains an effective amount of at least one benzenesulfonamide compound represented by the general formula:

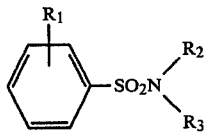

(I)

where $R_1$ is a hydrogen atom, a $C_1$–$C_5$ alkyl group, an acetylamino group or a halogen atom, $R_2$ is a hydrogen atom, a $C_1$–$C_5$ alkyl group, a cyclohexyl group or a phenyl group which may be substituted and $R_3$ is a $C_1$–$C_5$ alkyl group, a cyclohexyl group or a phenyl group which may be substituted, provided $R_2$ and $R_3$ may form together with N a saturated ring.

2. The heat sensitive record material according to claim 1, wherein the record layer contains at least one benzenesulfonamide compound of the general formula I in an amount of from 0.1 to 10 parts by weight relative to 1 part by weight of the chromogenic material.

3. The heat sensitive record material according to claim 1, wherein the record layer comprises 1 part by weight of the chromogenic material, from 0.1 to 10 parts by weight of at least one benzenesulfonamide compound of the general formula I, from 2 to 10 parts by weight of the acidic substance and from 2 to 10 parts by weight of the binder.

4. The heat sensitive record material according to claim 1, wherein the fluoran compound is selected from the group consisting of compounds represented by the general formula:

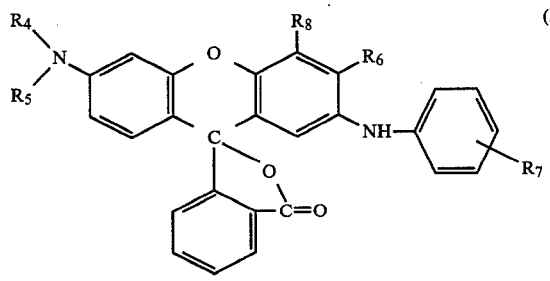

(II)

where $R_4$ is a $C_1$–$C_5$ alkyl group, $R_5$ is a $C_1$–$C_5$ alkyl group, a cyclohexyl group or a phenyl group which may be substituted, provided $R_4$ and $R_5$ may form together with the nitrogen atom a heterocyclic ring, $R_6$ is a hydrogen atom, a halogen atom, a $C_1$–$C_3$ alkoxy group or a $C_1$–$C_3$ alkyl group, $R_7$ is a hydrogen atom, a $C_1$–$C_3$ alkyl group, a halogen atom or a trifluoromethyl group, and $R_8$ is a hydrogen atom or a $C_1$–$C_3$ alkyl group.

5. The heat sensitive record material according to claim 1, wherein the fluoran compound is selected from the group consisting of 2-(2-chlorophenylamino)-6-diethylaminofluoran, 2-(2-chlorophenylamino)-6-di-n-butylaminofluoran, 2-anilino-3-methyl-6-diethylaminofluoran, 2-anilino-3-methyl-6-pyrrolidinylfluoran, 2-anilino-3-methyl-6-piperidinofluoran, 2-(3-trifluoromethylanilino)-6-diethylaminofluoran, 2-anilino-6-diethylaminofluoran, 2-anilino-3-methyl-6-(N-ethyl-N-p-tolyl)aminofluoran, 2-(p-ethoxyanilino)-3-methyl-6-diethylaminofluoran, 2-xylidino-3-methyl-6-diethylaminofluoran, 2-anilino-3-methyl-6-(N-methyl-N-cyclohexylamino)fluoran, 2-anilino-3-chloro-6-diethylaminofluoran, 2-anilino-3,4-dimethyl-6-diethylaminofluoran and 2-anilino-3-methoxy-6-dibutylaminofluoran.

6. The heat sensitive record material according to claim 1, wherein the acidic substance is a colorless solid phenolic compound or a colorless solid organic acid or its metal salt which is liquefied or vaporized at a temperature of 50° C. or higher.

7. The heat sensitive record material according to claim 1, wherein the acidic substance is 4,4'-isopropylidene-diphenol.

8. The heat sensitive record material according to claim 1, wherein the benzenesulfonamide compound of the general formula I is selected from the group consisting of N-(2-chlorophenyl)-4-methylbenzenesulfonamide, N-(4-chlorophenyl)-4-methylbenzenesulfonamide, N-(4-methylphenyl)-4-methylbenzenesulfonamide, N-(3-hydroxyphenyl)-4-methylbenzenesulfonamide, N-(4-hydroxyphenyl)-4-methylbenzenesulfonamide, N-(4-sulfamoylphenyl)-4-methylbenzenesulfonamide, N-(4-methoxyphenyl)-4-methylbenzenesulfonamide, 4-(piperidinosulfonyl)-acetanilide, N,N-dimethyl-4-(acethylamino)-benzenesulfonamide, 4-(morpholinosulfonyl)-acetanilide, N,N-dimethyl-4-methylbenzenesulfonamide, 4-(morpholinosulfonyl)-toluene, N-methyl-4-methylbenzenesulfonamide, 4-(4-N-methylpiperazinosulfonyl)-toluene, 4-(4-N-methylpiperazinosulfonyl)-acetanilide, N-(2-chlorophenyl)-benzenesulfonamide, N-(4-chlorophenyl)-benzenesulfonamide, N-(3-chlorophenyl)-benzenesulfonamide, N-(2-methylphenyl)-benzenesulfonamide, N-(2-methoxyphenyl)-benzenesulfonamide, N-(2,3-dichlorophenyl)-benzenesulfonamide, N-(3,4-dichlorophenyl)-benzenesulfonamide, N-(2-nitrophenyl)-benzenesulfonamide, morpholinosulfonylbenzene, N-phenylbenzenesulfonamide, N-cyclohexyl-benzenesulfonamide, N-(2-chlorophenyl)-4-chlorobenzenesulfonamide, N-(4-chlorophenyl)-4-chlorobenzenesulfonamide, N-(2-methylphenyl)-4-chlorobenzenesulfonamide, N-(4-methylphenyl)-4-chlorobenzenesulfonamide, N-(2-methoxyphenyl)-4-chlorobenzenesulfonamide, N-(2,3-dichlorophenyl)-4-chlorobenzenesulfonamide, N-(3,4-dichlorophenyl)-4-chlorobenzenesulfonamide, 4-(morphoninosulfonyl)-chlorobenzene, N-phenyl-4-chlorobenzenesulfonamide, N-cyclohexyl-4-chlorobenzenesulfonamide, N,N-dimethyl-4-chlorobenzenesulfonamide and N-(4-hydroxyphenyl)-2-methylbenzenesulfonamide.

9. The heat sensitive record material according to claim 1, wherein the binder is selected from polyvinyl alcohol, methyl cellulose, hydroxyethyl cellulose, carboxymethyl cellulose, gum arabic, starch, gelatin, casein, polyvinyl pyrrolidone, a styrene-maleic acid anhydride copolymer, a polyacrylic acid amide, a polyacrylic acid salt, a terpene resin and a petroleum resin.

10. The heat sensitive record material according to claim 1, wherein the chromogenic material, the acidic substance and the benzenesulfonamide compound of the general formula I are uniformly distributed in the record layer in particle form having a particle size of from 1 to 6 $\mu$m.

* * * * *